US011448447B2

(12) United States Patent
Bertolini et al.

(10) Patent No.: US 11,448,447 B2
(45) Date of Patent: Sep. 20, 2022

(54) ICE BUCKET ASSEMBLY FOR PRODUCING NUGGET ICE FOR REFRIGERATOR APPLIANCE

(71) Applicants: BSH Home Appliances Corporation, Irvine, CA (US); BSH Hausgeräte GmbH, Munich (DE)

(72) Inventors: Nilton Bertolini, Knoxville, TN (US); Cetin Abdullah Celik, Knoxville, TN (US); Silas Patrick Mallon, Knoxville, TN (US); Jorge Carlos Montalvo Sanchez, Knoxville, TN (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 51 days.

(21) Appl. No.: 16/898,486

(22) Filed: Jun. 11, 2020

(65) Prior Publication Data

US 2020/0300528 A1 Sep. 24, 2020

Related U.S. Application Data

(62) Division of application No. 15/925,800, filed on Mar. 20, 2018, now Pat. No. 10,782,058.

(51) Int. Cl.
*F25C 5/182* (2018.01)
*F25C 1/04* (2018.01)

(52) U.S. Cl.
CPC ..... *F25C 5/182* (2013.01); *F25C 1/04* (2013.01)

(58) Field of Classification Search
CPC .... F25C 5/046; F25C 1/04; F25C 5/14; F25C 5/182; F25C 2400/10; F25C 1/147; F25C 1/25; F25C 5/24; F25C 2400/08; Y10S 241/17
See application file for complete search history.

(56) References Cited

U.S. PATENT DOCUMENTS 3,662,564 A * 5/1972 Clearman ..... F25C 1/147 62/320
3,756,041 A * 9/1973 Hanson ..... F25C 1/147 425/331
5,056,688 A * 10/1991 Goetz ..... F25C 5/046 222/413
7,017,363 B2 * 3/2006 Lee ..... F25C 5/185 62/320
9,644,878 B2 5/2017 Mitchell et al.
9,714,783 B2 7/2017 Maroli
9,733,004 B2 8/2017 Mitchell et al.
(Continued)

*Primary Examiner* — Frantz F Jules
*Assistant Examiner* — Martha Tadesse
(74) *Attorney, Agent, or Firm* — Michael E. Tschupp; Andre Pallapies; Brandon G. Braun

(57) ABSTRACT

A refrigerator includes an ice compartment region disposed in at least one of a fresh food compartment or a freezer compartment; an ice maker disposed in the ice compartment region and configured to make ice pieces; and an ice bucket assembly configured to store the ice pieces made by the ice maker. The ice bucket assembly includes a mechanism for producing nugget ice from the ice pieces made by the ice maker and stored in the ice bucket assembly, the nugget ice being smaller in size as compared to the ice pieces made by the ice maker and stored in the ice bucket assembly.

8 Claims, 11 Drawing Sheets

(56) References Cited

U.S. PATENT DOCUMENTS

| | | | | |
|---|---|---|---|---|
| 2005/0044874 | A1* | 3/2005 | Lee | F25C 5/22 62/344 |
| 2006/0248912 | A1* | 11/2006 | Park | F25C 5/12 414/151 |
| 2010/0257889 | A1 | 10/2010 | Lee | |
| 2011/0308269 | A1* | 12/2011 | Mitchell | F25C 5/14 62/320 |
| 2013/0167575 | A1 | 7/2013 | Young, II | |
| 2013/0174596 | A1* | 7/2013 | Kim | F25C 5/00 62/320 |
| 2013/0276472 | A1* | 10/2013 | Mitchell | F25C 1/147 62/340 |
| 2013/0305763 | A1 | 11/2013 | Nuss | |
| 2014/0245774 | A1 | 9/2014 | Maroli | |
| 2016/0201967 | A1 | 7/2016 | Mitchell et al. | |
| 2016/0327326 | A1 | 11/2016 | Mitchell et al. | |
| 2017/0146280 | A1 | 5/2017 | Hitzelberger et al. | |
| 2017/0205132 | A1 | 7/2017 | Nuss et al. | |
| 2017/0234594 | A1 | 8/2017 | Mitchell et al. | |

* cited by examiner

SECTION CC

SECTION AA

SECTION BB

SECTION DD

SECTION EE

SECTION FF

SECTION GG

ICE BUCKET ASSEMBLY FOR PRODUCING NUGGET ICE FOR REFRIGERATOR APPLIANCE

CROSS-REFERENCES TO RELATED APPLICATIONS

This application is a divisional application, under 35 U.S.C. § 121, of U.S. application Ser. No. 15/925,800, filed Mar. 20, 2018, incorporated herein by reference in its entirety.

FIELD OF THE INVENTION

The present disclosure relates generally to a refrigerator appliance and to an ice bucket assembly for producing nugget ice for the refrigerator appliance. More particularly, the present disclosure relates to an ice bucket assembly for producing nugget ice from existing ice produced by an ice maker.

BACKGROUND OF THE INVENTION

In general, there are known dedicated ice machines for home use that are designed for the counter top or floor units and similar devices for commercial applications which can produce ice nuggets. Some users/customers prefer ice machines or ice makers that can produce small ice nuggets. These users/customers prefer the smaller size of the ice nuggets not only because they melt quickly and thereby cool down drinks much faster than standard sized ice cubes or ice pieces, but also because such ice nuggets have a soft, crunchy texture and are chewable.

SUMMARY OF THE INVENTION

An apparatus consistent with the present disclosure is directed to providing a home refrigerator appliance with an installed automatic ice maker and ice bucket assembly that is capable of producing ice nuggets on demand.

An apparatus consistent with the present disclosure is directed to providing an the ice bucket assembly for producing nugget ice that can be equipped in a refrigerator appliance at the time of manufacture, or interchanged with and used in place of a conventional or existing ice bucket assembly in a refrigerator appliance as an after-market retrofit device.

An apparatus consistent with the present disclosure is directed to providing an ice bucket assembly for producing nugget ice that can be positioned for example in a freezer compartment of the refrigerator appliance or in a dedicated ice making compartment located within a fresh food compartment of the refrigerator appliance.

An apparatus consistent with the present disclosure is directed to providing an ice bucket assembly for producing nugget ice from existing ice produced by an ice maker in any shape where the formed ice nuggets are dispensed as they are made, as opposed to being stored, thereby avoiding any clumping that may occur.

An apparatus consistent with the present disclosure is configured such that when the user/customer desires to dispense ice nuggets, as in any regular ice dispensing system, the standard ice made and stored in the ice bucket is then augered towards the front of the ice bucket assembly. As the ice cubes move through the ice bucket they are progressively crushed into ice pieces of a controlled size. The crushed ice pieces are then forced into an extrusion head, located at a front end opening of the ice bucket, where the crushed ice pieces are forced through the openings of the extrusion head to finally form the ice nuggets which can then be dispensed to the user/customer.

According to one aspect, the present disclosure provides a refrigerator comprising: an ice compartment region disposed in at least one of a fresh food compartment or a freezer compartment; an ice maker disposed in the ice compartment region and configured to make ice pieces; and an ice bucket assembly configured to store the ice pieces made by the ice maker, wherein the ice bucket assembly comprises means for producing nugget ice from the ice pieces made by the ice maker and stored in the ice bucket assembly, the nugget ice being smaller in size as compared to the ice pieces made by the ice maker and stored in the ice bucket assembly.

According to another aspect, the ice compartment region is disposed in the fresh food compartment.

According to another aspect, the ice compartment region is disposed in the freezer compartment.

According to another aspect, the ice compartment region is disposed in an upper corner of the fresh food compartment.

According to another aspect, the ice bucket assembly is removably mounted in the ice compartment region as a removable ice bucket assembly.

According to another aspect, the removable ice bucket assembly has a front cover, and the front cover has an opening in a bottom portion for discharging the nugget ice.

According to another aspect, the fresh food compartment includes a door, and further comprising an ice chute for an ice dispenser and being disposed in the door, the ice chute being configured to communicate with the opening in the front cover via an ice chute extension and to guide the nugget ice from the opening in the front cover to the ice dispenser.

According to another aspect, the ice bucket assembly comprises a storage chamber configured to store the ice pieces made by the ice maker.

According to another aspect, the ice bucket assembly comprises a crushing chamber configured to crush the ice pieces made by the ice maker and stored in the storage chamber.

According to another aspect, the ice bucket assembly comprises an extrusion chamber configured to house the means for producing nugget ice.

According to another aspect, the ice bucket assembly comprises at least one auger configured to move the ice pieces, whether uncrushed or crushed, through the storage chamber, the crushing chamber, and the extrusion chamber.

According to another aspect, the means for producing nugget ice comprises an extrusion head disposed in the extrusion chamber.

According to another aspect, the ice bucket assembly has a front cover, and the front cover has an opening in a bottom portion for discharging the nugget ice, and wherein the extrusion head is disposed proximate to the opening in the front cover.

According to another aspect, the present disclosure provides an ice bucket assembly for use with an ice maker in a refrigerator, the ice bucket assembly comprising: a storage chamber configured to store ice pieces made by the ice maker; a crushing chamber configured to crush the ice pieces made by the ice maker and stored in the storage chamber and thereby produce crushed ice; an extrusion chamber having an extrusion head configured to produce nugget ice from the crushed ice; and at least one auger configured to move the ice pieces, whether uncrushed or crushed, through the storage chamber, the crushing chamber, and the extrusion chamber, wherein the nugget ice produced by the extrusion head is smaller in size as compared to the ice pieces made by the ice maker and stored in the ice bucket assembly prior to production of the nugget ice.

According to another aspect, the ice bucket assembly is configured to be removably mounted in an ice compartment region of the refrigerator as a removable ice bucket assembly.

According to another aspect, the removable ice bucket assembly has a front cover, and the front cover has an opening in a bottom portion for discharging the nugget ice.

According to another aspect, the extrusion head is disposed proximate to the opening in the front cover.

According to another aspect, the extrusion head comprises a fixed extrusion plate having a plurality of extrusion openings, and a rotatable ice breaker which includes a curved surface to produce the nugget ice of a desired length.

According to another aspect, the present disclosure provides a refrigerator comprising: an ice compartment region disposed in at least one of a fresh food compartment or a freezer compartment; an ice maker disposed in the ice compartment region and configured to make ice pieces; and an ice bucket assembly comprising a storage chamber configured to store ice pieces made by the ice maker, a crushing chamber configured to crush the ice pieces made by the ice maker and stored in the storage chamber and thereby produce crushed ice; and an extrusion chamber having an extrusion head configured to produce nugget ice from the crushed ice, wherein the nugget ice produced by the extrusion head is smaller in size as compared to the ice pieces made by the ice maker and stored in the ice bucket assembly prior to production of the nugget ice.

BRIEF DESCRIPTION OF THE DRAWING FIGURES

The accompanying drawing figures incorporated in and forming a part of this specification illustrate several aspects of the invention, and together with the description serve to explain the principles of the invention.

Figure 6B:
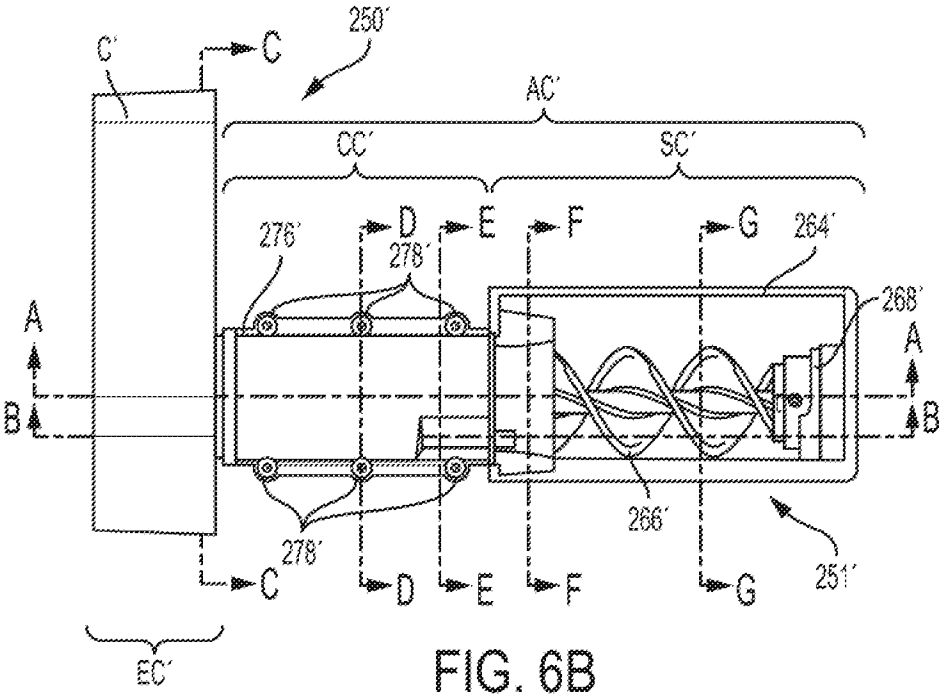
Figure 6D:
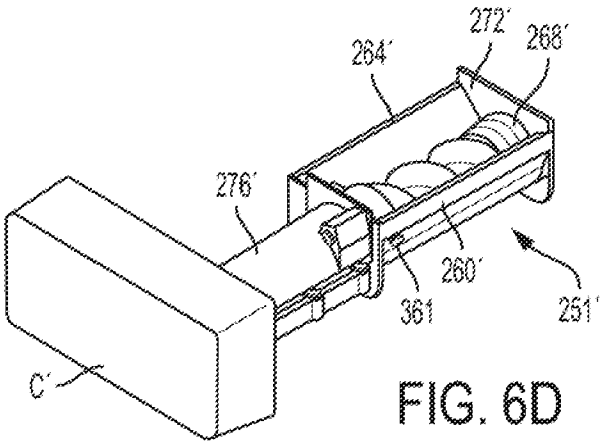
Figure 7C:
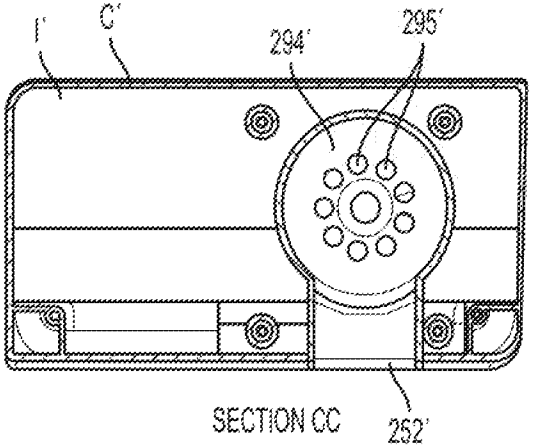
Figure 7A:
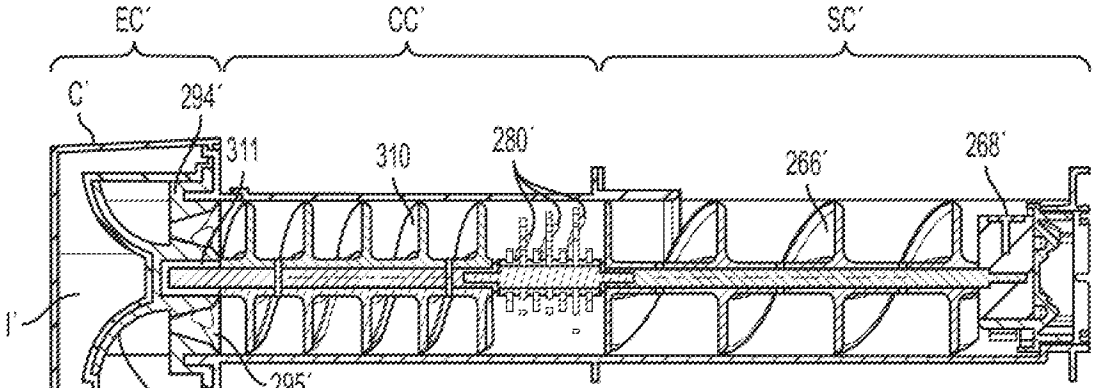
Figure 7B:
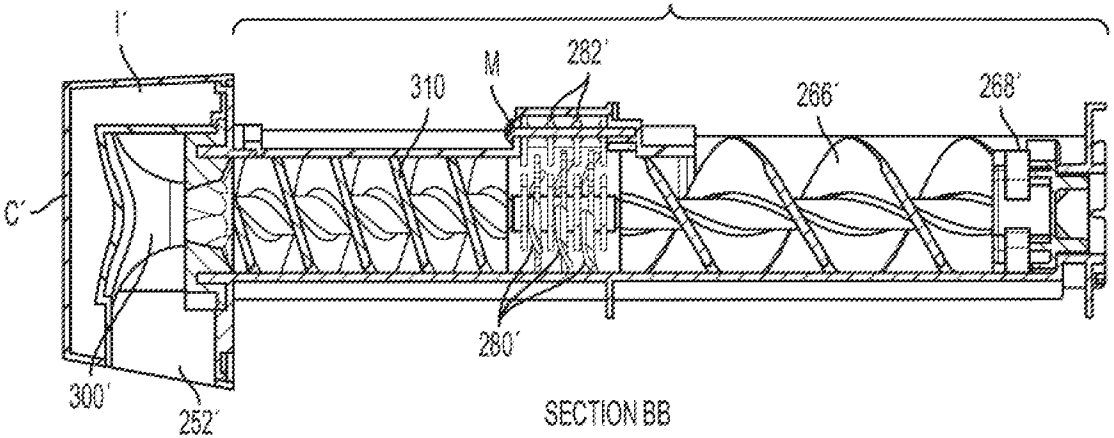
Figure 8A:
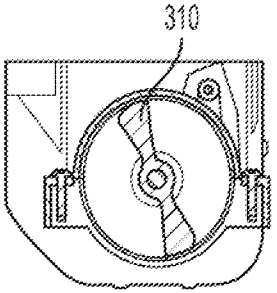
Figure 8B:
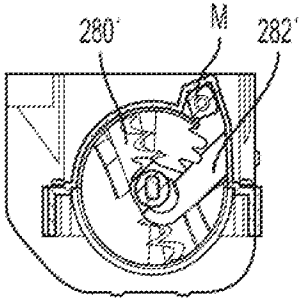
Figure 8C:
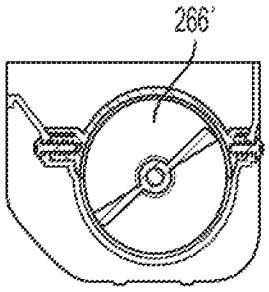
Figure 8D:
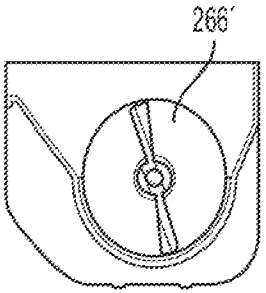
Figure 9:
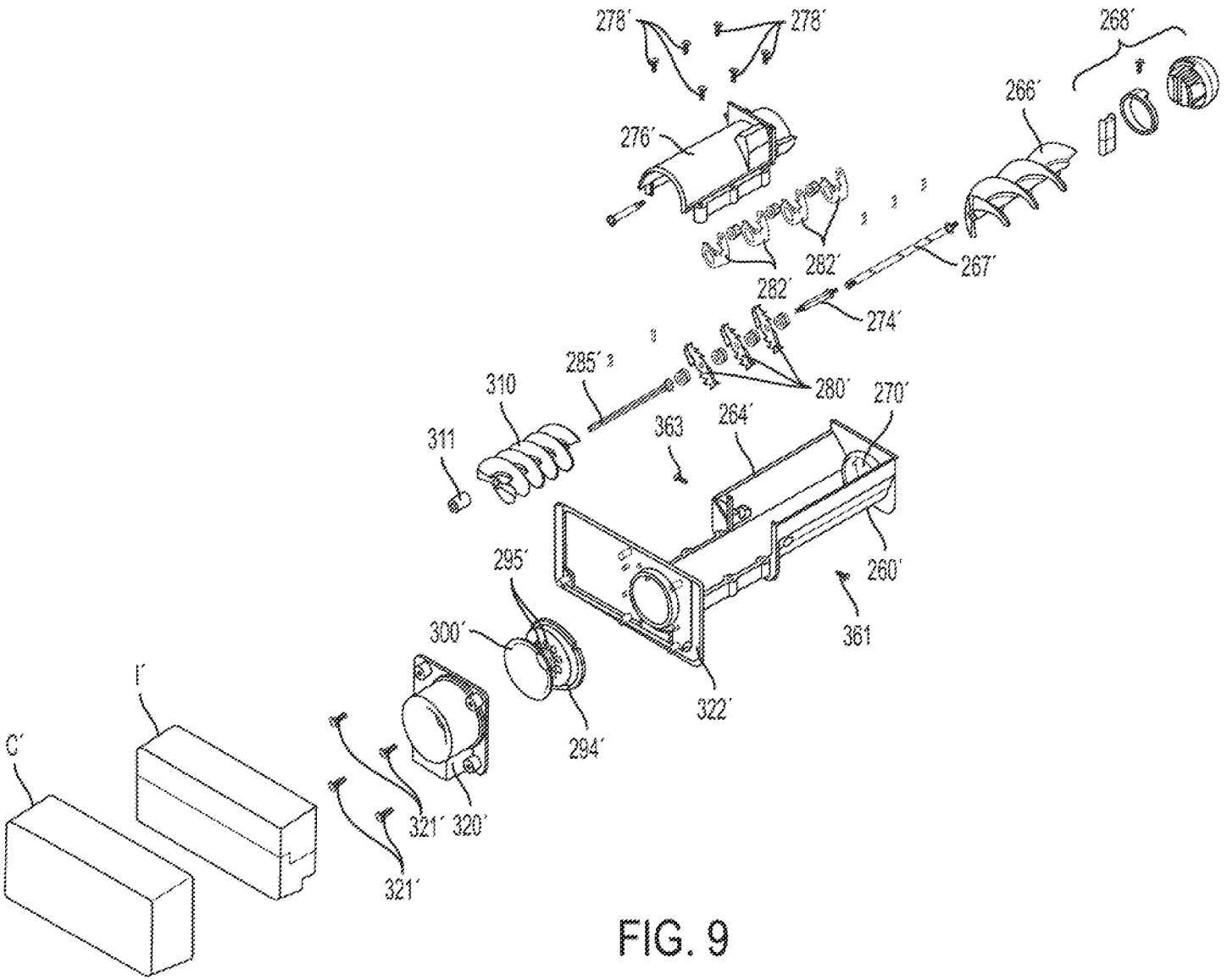
Figure 10:
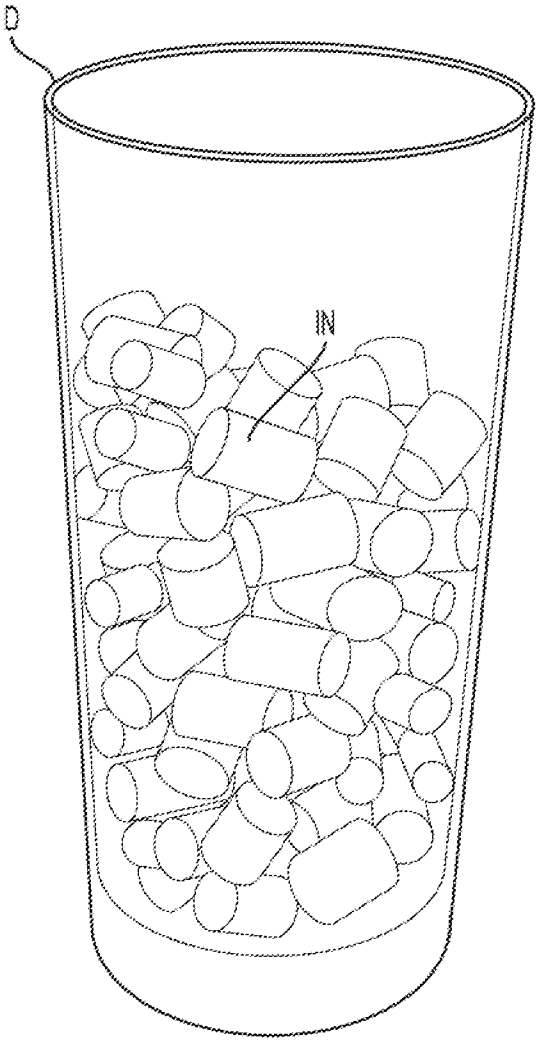

FIGS. 6A, 6B, 6C, and 6D are various views of the ice bucket assembly for producing nugget ice according to another exemplary embodiment consistent with the present disclosure;

FIGS. 7A, 7B, and 7C are various sectional views of the assembled auger and cover group together with the extrusion chamber of the ice bucket assembly for producing nugget ice taken along the lines as shown in FIG. 6B according to an exemplary embodiment consistent with the present disclosure;

FIGS. 8A, 8B, 8C, and 8D are various sectional views of the assembled auger and cover group together with the extrusion chamber of the ice bucket assembly for producing nugget ice taken along the lines as shown in FIG. 6B according to an exemplary embodiment consistent with the present disclosure;

FIG. 9 is an exploded view of the ice bucket assembly for producing nugget ice according to the exemplary embodiment of FIGS. 6A to 6D consistent with the present disclosure; and FIG. 10 illustrates a view of the nugget ice produced by the ice bucket assembly for producing nugget ice according to an exemplary embodiment consistent with the present disclosure and disposed in a drinking glass.

DETAILED DESCRIPTION OF THE EXEMPLARY EMBODIMENTS

The exemplary embodiments set forth below represent the necessary information to enable those skilled in the art to practice the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

Moreover, it should be understood that terms such as top, bottom, front, back, middle, and the like used herein are for orientation purposes with respect to the drawings when describing the exemplary embodiments and should not limit the present invention. Also, terms such as substantially, approximately, and about are intended to allow for variances to account for manufacturing tolerances, measurement tolerances, or variations from ideal values that would be accepted by those skilled in the art.

As used herein, the terms "ice nuggets" or "nugget ice" refer to smaller ice pieces that are preferably, but not necessarily, tubular in shape, with a diameter of about 12 mm (or approximately ½ inch) and a length of 12 to 15 mm.

Figure 1:
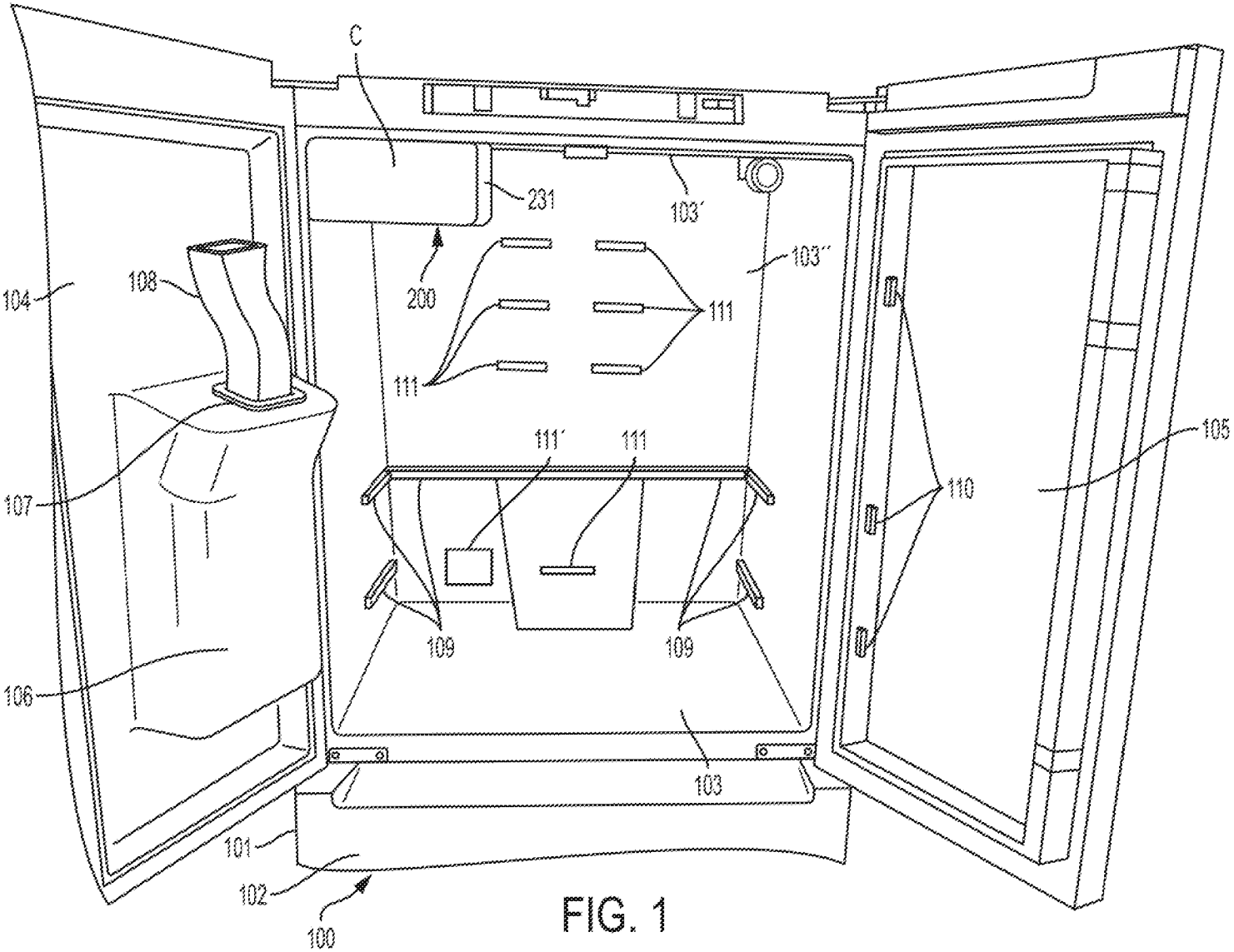
FIG. 1 is a fragmentary perspective view showing the inside of a refrigerator appliance including an automatic ice maker and an ice bucket assembly for producing nugget ice in an ice compartment region located in a fresh food compartment according to an exemplary embodiment consistent with the present disclosure.

FIG. 1 illustrates a front perspective view of a French door-bottom mount style refrigerator 100 with the doors open to reveal an ice compartment region 200 according to an exemplary embodiment consistent with the present disclosure. More specifically, the refrigerator 100 includes an insulated body having a freezer compartment 101 (bottom mount style) covered by a freezer door 102, and a fresh food compartment 103 (also referred to as a refrigerator compartment 103) located above the freezer compartment 101 and having two refrigerator doors 104 and 105 (French door style) which are shown in the open position. While two refrigerator doors are shown, clearly a single refrigerator door could be used, or more than two doors such as with door-in-door configurations. The shelves and food racks have been removed from inside the fresh food compartment 103 and from the inside of the refrigerator doors 104 and 105 for ease of understanding. The left door 104 includes a projecting housing portion 106 on the inner liner and which accommodates a water and ice dispenser assembly (not visible) accessible by the user on the front side of the door 104. An opening 107 of a dispenser ice chute (not visible) for guiding the nugget ice to the dispenser is arranged at the top of the projecting housing portion 106. The dispenser ice chute communicates with an opening 252 (see FIG. 2) in a front cover C of the ice bucket assembly via an ice chute extension 108. The inner liner side walls of the fresh food compartment 103 include protrusions 109 for supporting shelving (not shown). The right door 105 includes projections 110 for supporting door racks (not shown). Also shown in FIG. 1 are air openings 111 for cold air to enter into the fresh food compartment 103 (see the smaller elongated slots) and an opening 111' for return air to exit the fresh food compartment 103 (see the larger square opening on the bottom left). The freezer compartment is typically set at −18° C. or colder, and the fresh food compartment is typically set in a range of 1° C. to 4° C.

Figure 2:
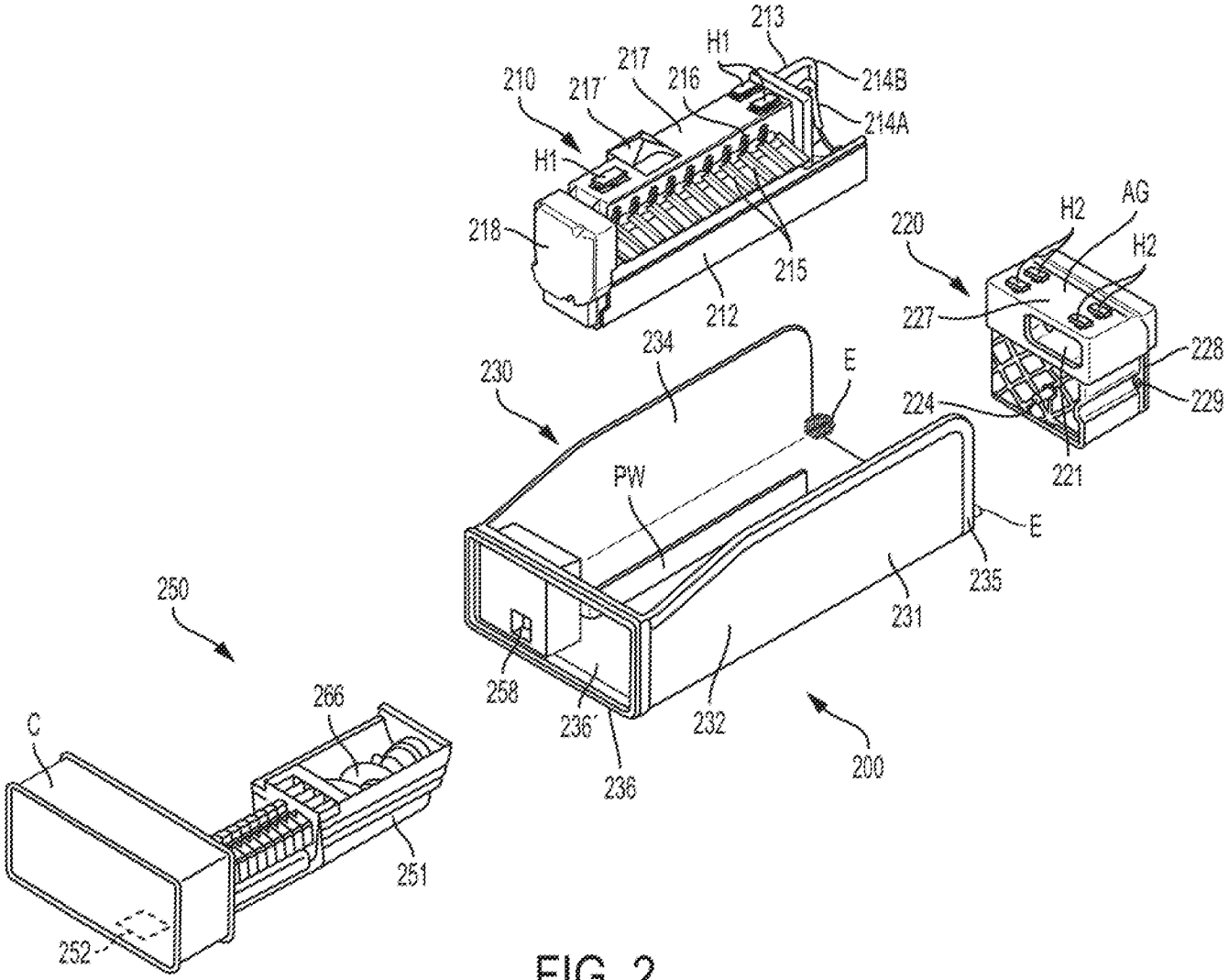
FIG. 2 is an exploded perspective view showing the ice compartment region of FIG. 1 including the major components according to an exemplary embodiment consistent with the present disclosure.

FIG. 2 is an exploded perspective view of the ice compartment region 200 including an ice bucket assembly 250 for producing nugget ice according to an exemplary embodiment consistent with the present disclosure. More specifically, the ice compartment region 200 includes the major components of an ice maker assembly 210, an air handler/auger motor assembly 220, an ice compartment housing assembly 230, and the ice bucket assembly 250 for producing nugget ice. Aspects of each of the individual assemblies 210-250 will be discussed in more detail below in connection with the remaining drawings.

As shown in FIG. 2, the ice maker assembly 210 includes, for example, an ice maker tray/evaporator 212 having an evaporator cooling tube 213 (formed of at least one of copper or a copper alloy, for example) which is, for example, die cast over-molded inside an ice maker tray portion (formed of at least one of aluminum, an aluminum alloy, or other die cast alloys, for example), such that the evaporator cooling tube 213 is embedded in and thus in direct contact with the ice maker tray portion so as to form the ice maker tray/evaporator 212 as a one piece unit. The evaporator cooling tube 213 has an evaporator tube inlet 214A with a capillary connection (i.e., the end is swaged and connected to a capillary tube), and an evaporator cooling tube outlet (suction tube) 214B. While a direct cooling type ice maker assembly 210 is shown in FIG. 2, other types of ice makers can also be used, such as but not limited to, air cooled ice makers such as plastic twist trays and other metallic trays. Moreover, the present disclosure does not limit the ice type/shape produced by the ice maker.

As shown in FIG. 2, ejector fingers 216 are arranged on a rotatable shaft (not shown) and are movable in spaces between projections 215. An ice maker bracket 217 is disposed above the mold with a plurality of cavities (not visible) and includes a water fill cup 217' for directing water into the mold cavities. The ice maker bracket 217 is attached via fasteners (for example, four screws) to the ice maker tray/evaporator 212. The ice maker bracket 217 also includes a plurality (for example three) of mounting hooks H1 on a top surface thereof for engaging corresponding mounting members (not shown) formed in a foamed-in bracket (not shown) which is part of the refrigerator structure. The mounting hooks H1 allow the ice maker assembly 210 to be easily assembled to an inner top wall or liner 103' of the fresh food compartment 103 via the foamed-in bracket. A wire harness (not shown) for connecting the ice maker assembly 210 to the refrigerator 100 may be connected to corresponding connectors (not shown) in, for example, the inner top wall 103' of the fresh food compartment 103 at a location within the ice compartment region 200. A gear box 218 is positioned at a front end portion (facing the front of the refrigerator) of the ice maker tray/evaporator 212 and includes gears and a motor (not shown) for driving the rotatable shaft for the ejector fingers 216.

With reference to FIG. 2, the air handler/auger motor assembly 220 is disposed at the rear portion of the ice compartment region 200. The air handler/auger motor assembly 220 includes an air guide AG with an air passage 221 having an electric motor driven fan (not visible) disposed therein. The air passage 221 is located at an upper portion of the air handler/auger motor assembly 220. The air passage 221 communicates with the airflow passage under the ice maker tray/evaporator 212. An inlet of the electric motor driven fan communicates with the airflow passage under the ice maker tray/evaporator 212 and through the evaporator fins (not shown) such that the electric motor driven fan creates a suction and draws cool air from the ice maker tray/evaporator 212 and discharges the cool air through the air passage 221 and either over or around the ice bucket 251 to prevent the ice pieces from melting. The cool or cold air that circulates inside the ice compartment region 200 is only required to keep the ice compartment 200 cold enough to prevent ice stored in the ice bucket 251 from melting which is normally below −3° C. and preferably, but not necessarily, around −5° C. An auger motor (not visible) is located at a lower portion of the air handler/auger motor assembly 220. The auger motor includes a motor shaft 224 that is connected via an auger coupler 268 to a rear auger 266. The rear auger 266 guides the ice pieces to the crushing blades and the opening in the front cover which are discussed later.

The air handler/auger motor assembly 220 includes a plurality (for example four) of mounting hooks H2 on the top surface 227 (see FIG. 2) for engaging corresponding mounting members (not shown) formed in the foamed-in bracket which is part of the refrigerator structure for mounting the air handler/auger motor assembly 220 to the fresh food compartment 103. The air handler/auger motor assembly 220 may also include one or more vertical mounting plates 228 with fastener holes 229 (see FIG. 2) for further mounting the air handler/auger motor assembly 220 to an inner back wall or liner 103" of the fresh food compartment 103 via fasteners such as screws (not shown).

With reference to FIG. 2, the ice compartment region 200 is formed by the ice compartment housing assembly 230 which comprises a U-shaped, insulated housing 231 that cooperates with the inner top wall 103' and the inner back wall 103" of the fresh food compartment 103 (see FIG. 1). As shown in FIG. 2, the U-shaped, insulated housing 231 is contoured to fit the shape of the inner top wall 103' and an inner back wall 103" of the fresh food compartment 103. The U-shaped, insulated housing 231 includes a U-shaped outer wall 232, a U-shaped insulation (not shown) (formed of, for example, expanded polypropylene (EPP), expanded polystyrene (EPS), vacuum insolated panel (VIP)), a U-shaped inner wall 234, a gasket 235 that is disposed between an edge of the U-shaped, insulated housing 231 and the inner top wall 103' and the inner back wall 103" of the fresh food compartment 103, and a housing collar 236 that is disposed on an open front portion of the U-shaped, insulated housing 231, the housing collar 236 having an opening 236' therein for receiving the ice bucket 251. The ice bucket 251 has an insulated front cover C with a finger grip groove G' (see FIG. 6C) on the bottom. The ice bucket 251 is shown as a removable ice bucket for storing ice pieces, the removable ice bucket being removably disposed in the ice compartment region 200. The gasket 235 may be an extruded gasket formed from, for example, polyvinyl chloride (PVC) that is rubberized, and that is inserted into a groove that is formed along the edge of the U-shaped, insulated housing 231. The housing collar 236 is also shown with an opening 258 which would be used with a cube/crush DC motor and reed switch assembly (not shown). The cube/crush DC motor and reed switch assembly would be used to control whether cubed or crushed ice is delivered to the user when an ice bucket assembly having a more traditional ice cube/crush gate member in the front cover C is used in place of the ice bucket assembly 250 for producing nugget ice of the present disclosure.

As shown in FIG. 2, the insulated housing 231 includes an inner L-shaped positioning wall PW for positioning the U-shaped, insulated housing into position over the ice maker assembly 210. The U-shaped, insulated housing 231 also includes locating extensions E (for example, two extensions E) extending from a lower rear portion of the edge, the locating extensions E being configured to fit into a bracket (not shown) positioned in the inner back wall 103" of the fresh food compartment 103. Moreover, the housing collar 236 having the opening 236' therein for receiving the ice bucket 251 further includes a plurality of fastener holes configured to receive fasteners (not shown) for fastening the U-shaped, insulated housing 231 to the inner top wall 103' of the fresh food compartment 103 (see FIG. 1). With such a construction, the U-shaped, insulated housing 231 is slid into position in the upper left hand corner of the fresh food compartment 103 and over the ice maker assembly 210 and then held in place by the locating extensions E at the lower rear portion and the fasteners in the holes.

With reference to FIG. 2, the ice bucket assembly 250 for producing nugget ice includes the ice bucket or bin 251 for storing ice pieces and in which the auger, crusher, and extruder structure (as will be explained in detail below) is disposed, and the insulated front cover C. As noted above, the ice bucket 251 is removably mounted in the ice compartment region 200. As also noted above, the insulated front cover C has an ice bucket outlet opening 252 (see also FIG. 6C) on the bottom through which ice nuggets are delivered when a user dispenses the ice nuggets. The ice bucket outlet opening 252 cooperates with the ice chute extension 108 (see FIG. 1) to deliver ice nuggets to the dispenser when the door 104 is in a closed position. The interface between the ice bucket outlet opening 252 and the top of the ice chute extension 108 can be sealed with a gasket, have a partial or open gasket, or have no gasket at all. In the latter two cases, some air is permitted to move between the fresh food compartment 103 and the ice compartment 200 by moving into the region inside the ice chute extension 108 and through the ice bucket outlet opening 252 and into the ice compartment region 200 and vice versa.

Figure 3A:
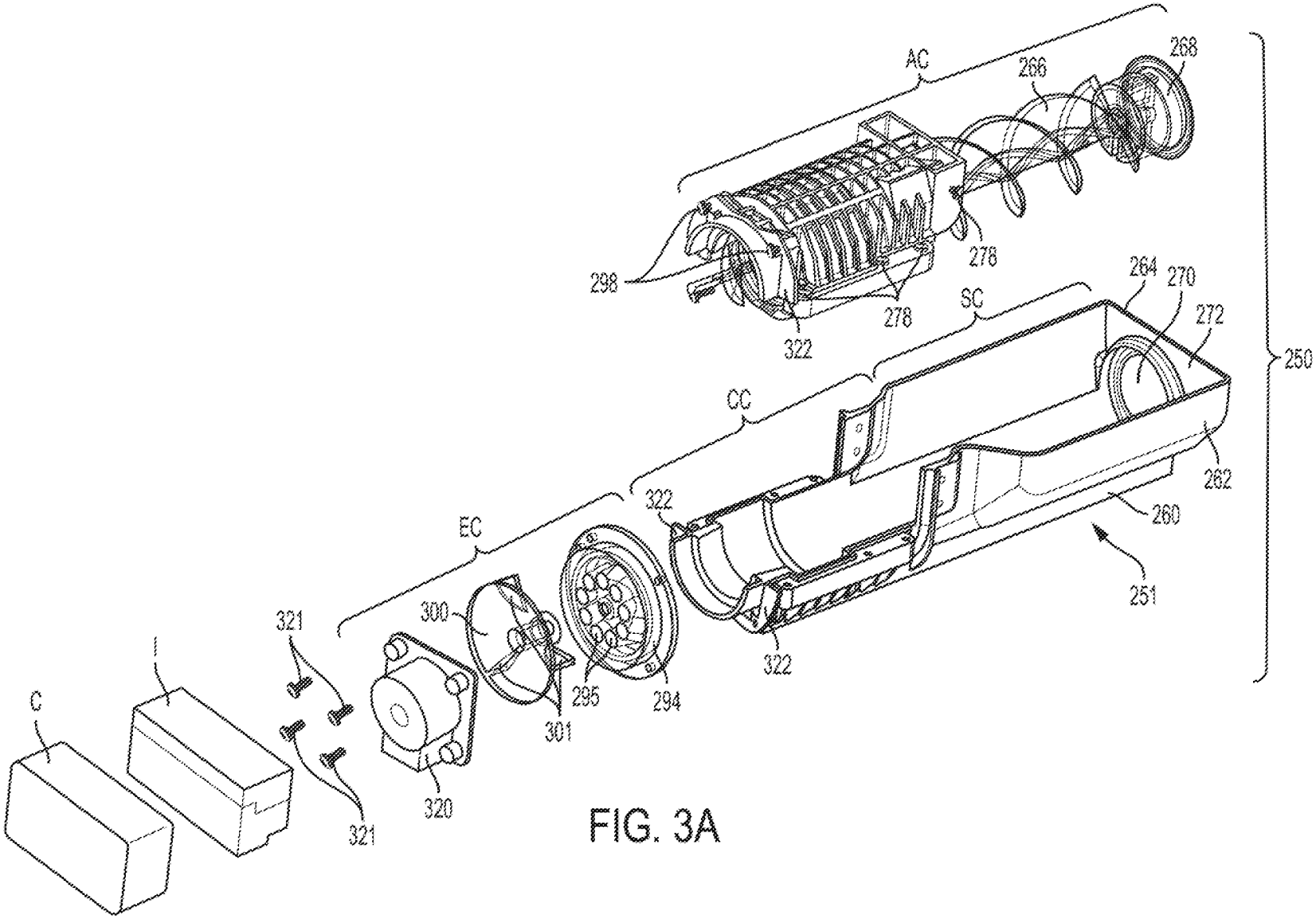
FIGS. 3A and 3B are exploded views of the ice bucket assembly for producing nugget ice and of the auger and cover group, respectively, according to one exemplary embodiment consistent with the present disclosure.
Figure 3B:
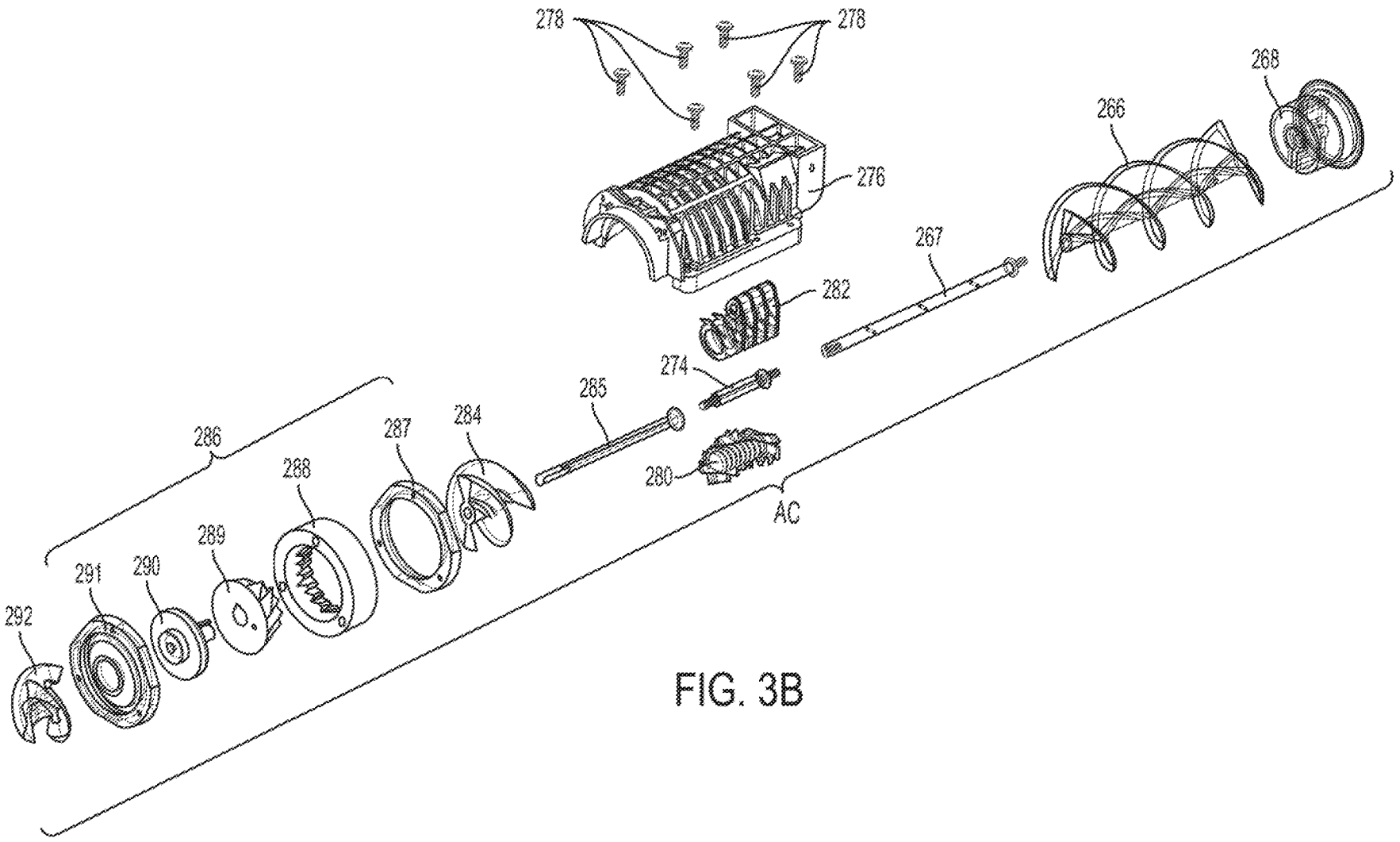
Figure 4:
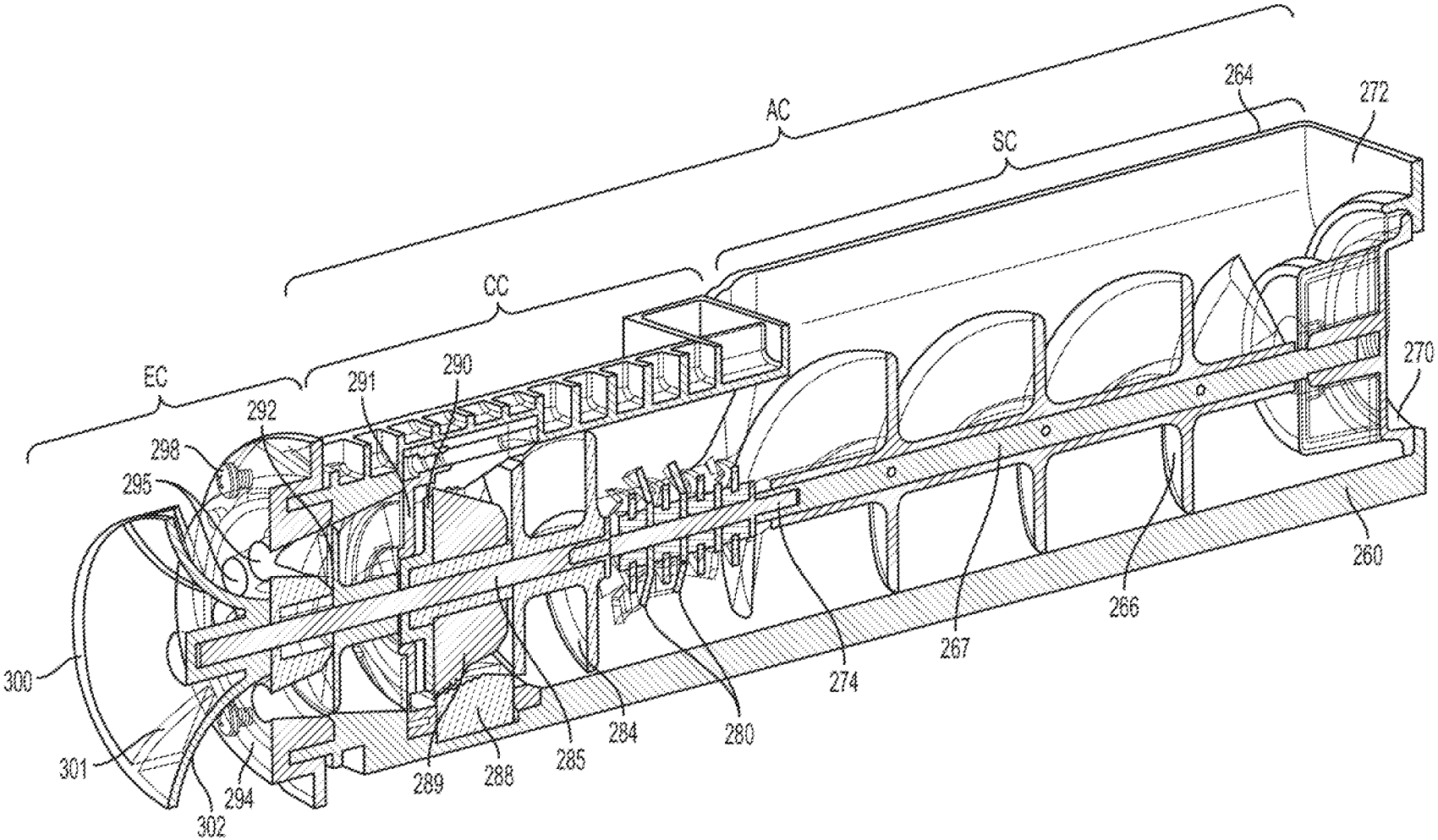
FIG. 4 is a perspective sectional view of the assembled auger and cover group together with the extrusion head and ice broom of the ice bucket assembly for producing nugget ice of FIGS. 3A and 3B according to one exemplary embodiment consistent with the present disclosure.
Figure 5:
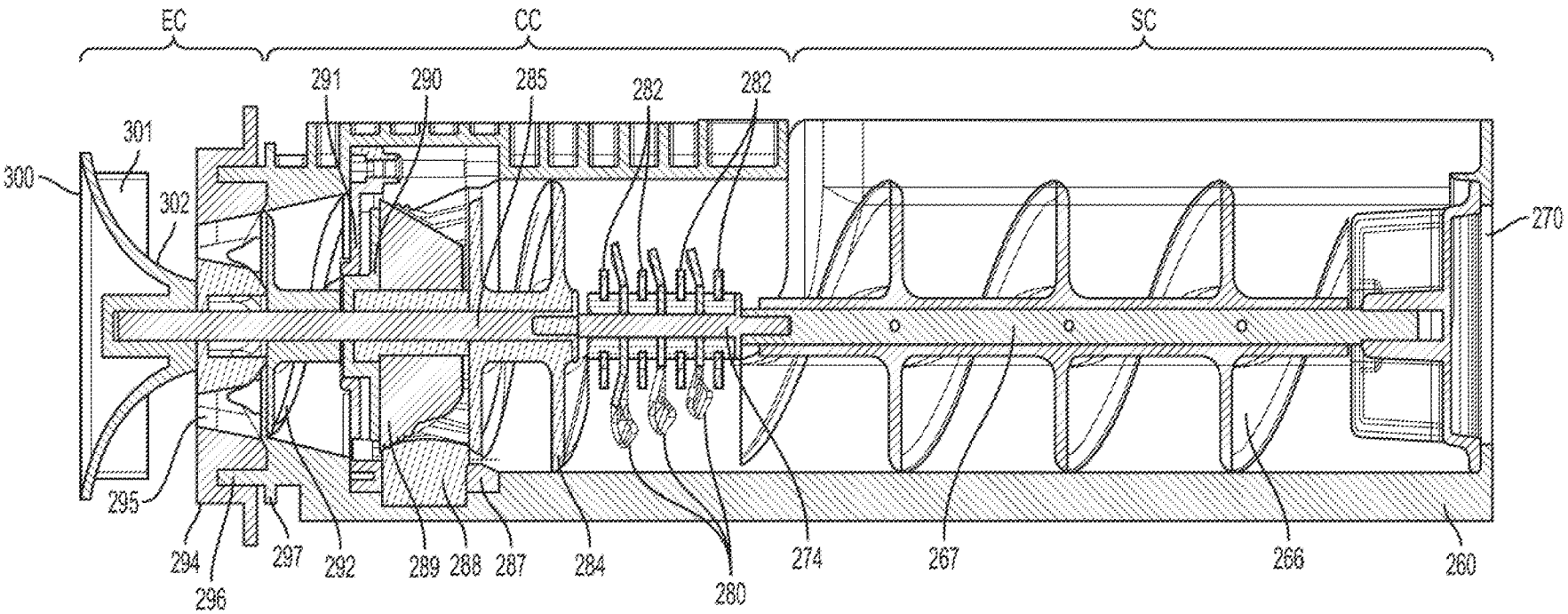
FIG. 5 is an elevational sectional view of the assembled auger and cover group together with the extrusion head and ice broom of the ice bucket assembly for producing nugget ice of FIGS. 3A and 3B according to one exemplary embodiment consistent with the present disclosure.

With reference to FIGS. 3A-5, a detailed description will now be made of the ice bucket assembly 250 for producing nugget ice according to one exemplary embodiment consistent with the present disclosure. FIG. 3A is an exploded view of the ice bucket assembly 250 for producing nugget ice and FIG. 3B is an exploded view of the auger and cover group AC per se. FIGS. 4 and 5 are various sectional views of the assembled auger and cover group AC together with the extrusion head and ice broom of the ice bucket assembly 250 for producing nugget ice of FIGS. 3A and 3B.

More specifically, as shown in FIGS. 3A, 4, and 5, the ice bucket assembly 250 for producing nugget ice includes three main chambers or regions including a storage chamber or region SC configured to store the ice pieces produced by the ice maker (which can be any ice maker such as, for example, ice maker assembly 210), a crushing chamber or region CC configured to crush the ice pieces made by the ice maker assembly 210 and stored in the storage chamber SC, and an extrusion chamber or region EC configured to house means for producing nugget ice. The three main chambers or regions will be discussed in order from the rear of the ice bucket assembly 250 for producing nugget ice to the insulated front cover C thereof.

The ice bucket 251 is formed by an ice bucket bottom cover 260. The ice bucket bottom cover 260 has an enlarged rear portion 262 with an open top 264 where the ice pieces produced by the ice maker assembly 210 fall into and collect for storage until a user/consumer wants to dispense ice nuggets. The enlarged rear portion 262 also houses the rear auger 266 which is formed by a helical or spiral blade mounted on a rotatable rear auger shaft 267. The rear end of the rear auger shaft 267 of the rear auger 266 is connected to the auger coupler 268 which passes through an opening 270 in the rear wall 272 of the ice bucket bottom cover 260. The auger coupler 268 is in turn connected to the motor shaft 224 of the auger motor (see FIG. 2). The front end of the rear auger shaft 267 of the rear auger 266 is connected to a middle auger shaft 274.

An ice bucket top cover 276 is fixed to the ice bucket bottom cover 260 by a plurality of fasteners 278 such as screws or bolts (see especially FIG. 3B). The ice bucket top cover 276 is positioned over the crushing chamber or region CC. The crushing chamber or region CC houses a plurality of rotary ice breaker or crusher blades 280 which are mounted on the middle auger shaft 274 and are separated by spacers from a plurality of fixed ice breaker or crusher blades 282. The fixed crusher blades 282 are mounted to an inside wall of the ice bucket top cover 276 by a mounting member M (see FIGS. 7B and 8B). The rotary ice breaker or crusher blades 280 move toward the fixed ice breaker or crusher blades 282 to thereby crush the ice cubes into smaller pieces. The crushing chamber or region CC also houses a middle auger 284 mounted on a front auger shaft 285 which is connected to the middle auger shaft 274, such that the rear auger shaft 267, the middle auger shaft 274, and the front auger shaft 285 rotate together. Still further, a burr gear assembly 286 is housed in the crushing chamber or region CC. The burr gear assembly 286 includes, but is not limited to, a funnel 287 mounted to the ice bucket top and bottom covers 276 and 260 and which guides the crushed ice to the burr gear, an ice grinder outer 288 fixed to the funnel 287 by suitable fasteners such as screws or bolts, a rotatable ice grinder inner 289, an adaptor 290 mounted on the front auger shaft 285 and which is used to attach the ice grinder inner 289 to the front auger shaft 285, and a shaft support 291 for supporting the front auger shaft 285. Finally, a front auger 292 is mounted on the front auger shaft 285. Together, the crusher blades 280, 282, burr gear assembly 286, and middle and front augers 284 and 292 are configured to crush the ice pieces made by the ice maker and stored in the storage chamber SC and thereby produce crushed ice or ice slush and convey the crushed ice toward the extrusion chamber EC.

At the front of the ice bucket assembly 250 for producing nugget ice is the insulated front cover C in which is formed the extrusion chamber or region EC configured to house means for producing nugget ice. In particular, the means for producing nugget ice comprises an extrusion head or plate 294 disposed in the extrusion chamber EC. The extrusion head 294 is formed with a plurality of circular openings 295 arranged around the center of the extrusion head 294. As best shown in FIGS. 4 and 5, the extrusion head 294 is fitted over an annular flange 296 on the front end 297 of the ice bucket top and bottom covers 276 and 260 and fixed by suitable fasteners 298 (see FIG. 3A and only one shown in FIG. 4) such as screws or bolts. As best seen in FIG. 5, each of the openings 295 is formed as a tapered bore which has a larger diameter at the rear where the crushed ice pieces in the form of ice slush first enters and gradually tapers down to a smaller diameter at the outlet. Thus, as the crushed ice or ice slush is forced through the gradually narrowing openings 295 of the extrusion head 294 by the front auger 292, the ice slush is compacted and extruded from the openings 295 in tubular form in a way similar to meat being extruded from a meat grinder. A rotatable ice breaker or ice broom 300 is mounted on the end of the front auger shaft 285. The ice broom 300 has a plurality of pallet features 301 and a curved surface 302, such that when the extruded ice hits the curved surface 302 the extruded ice or extrusion breaks and forms the desired ice nugget length which is preferably, but not necessarily, approximately 15 mm as the ice is extruded from the openings 295 of the extrusion head 294 in tubular form. The pallet features 301 move the ice once the extruded ice is cut to length, as the ice broom 300 rotates with the front auger shaft 285. The ice broom 300 is disposed inside an inner cover 320 which is mounted via a plurality of screws 321 to the ice bucket top and bottom covers 276 and 260 at the front 322 of the ice bucket 251 (see FIG. 3A). The insulation I for the insulated front cover C is fitted in the cover C and has cut-out portions for the inner cover 320 and the opening 252 (see FIGS. 2, 3A, and 7A to 7C).

The extrusion head 294 is disposed proximate to the opening 252 in the insulated front cover C, so that once the extruded ice has been cut into individual ice nuggets by hitting the curved surface 302 of the ice broom 300, the ice nuggets can then be dispensed by the user/consumer through the opening 252 (see FIG. 2 and also FIGS. 6C and 7A-7C for the opening 252, 252') in the insulated front cover C and to the ice chute extension 108 and the dispenser ice chute (see opening 107) to deliver the ice nuggets to the dispenser (in the region of the projecting housing portion 106) (see FIG. 1) when the door 104 is in a closed position.

FIGS. 6A-6D, 7A-7C, 8A-8D, and 9 illustrate another embodiment of the ice bucket assembly 250' for producing nugget ice. When describing this embodiment, like or similar structure will be denoted with like reference numerals except that a prime (') sign will be included, whereas new elements will be denoted by a different reference numeral.

Figure 6A:
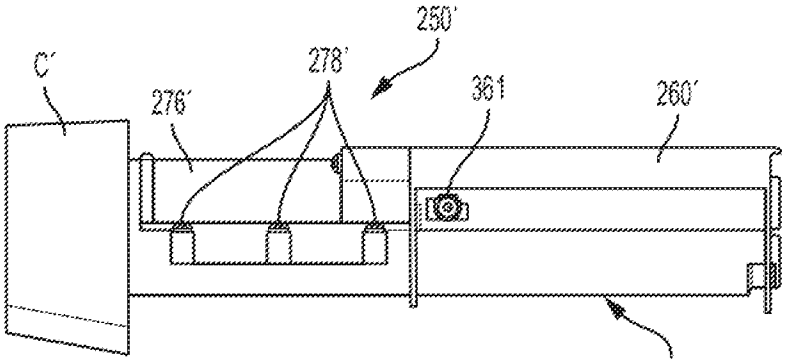
Figure 6C:
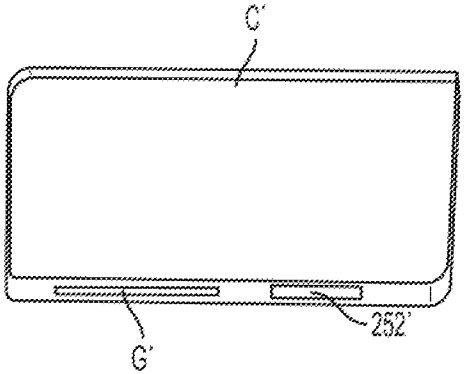

With reference to FIGS. 6A to 9, the description above regarding the storage chamber or region SC and the crushing chamber CC in FIGS. 3A to 5 is equally applicable here up to where the rotary crusher blades 280' and fixed ice crusher blades 282' end and the next section begins where middle auger 284, the burr gear assembly 286, and the front auger 292 were located in the previous embodiment. In particular, FIGS. 6A to 8D are various sectional views through the assembled auger and cover group AC' together with the extrusion chamber EC' according to another exemplary embodiment of the present disclosure, whereas FIG. 9 is an exploded view of the ice bucket assembly 250' for producing nugget ice according to the further exemplary embodiment of FIGS. 6A to 8D. In this further exemplary embodiment, the middle auger 284, the burr gear assembly 286, and the front auger 292 are replaced with an elongated front auger 310 that extends from the ice crusher blades 280', 282' all the way to the beginning of the openings 295' of the extrusion head 294' (see especially FIGS. 7A and 7B). The elongated front auger 310 has a tighter spiral than the spiral of the rear auger 266' and is configured to force the crushed ice pieces or ice slush into the extrusion head 294'. An auger shaft front ring 311 is disposed on the front auger shaft 285' between the elongated front auger 310 and the extrusion head 294' to rotatably mount the front end of the front auger shaft 285' in the extrusion head 294' (see FIGS. 7A and 9). As shown in FIGS. 6A, 6D, and 9, additional fasteners 361 and 363 such as screws or bolts can be used to further secure the ice bucket top and bottom covers 276' and 260' together at a side location.

A rotatable ice breaker 300' is mounted on the end of the front auger shaft 285'. The ice breaker 300' has a curved surface 302' (see FIG. 7A), such that when the extruded ice hits the curved surface 302' the extruded ice or extrusion breaks and forms the desired ice nugget length such as approximately 15 mm as the ice is extruded from the openings 295' of the extrusion head 294' in tubular form. The ice breaker 300' is disposed inside an inner cover 320' which is mounted via a plurality of screws 321' to the front wall 322' of the ice bucket 251'. The insulation I' for the insulated front cover C' is fitted in the cover C' and has cut-out portions for the inner cover 320' and the opening 252' (see FIGS. 7A to 7C).

When in use, the ice bucket assembly 250, 250' for producing ice nuggets according to an exemplary embodiment consistent with the present disclosure supplies nugget ice on demand. In operation, the ice maker assembly 210 produces the standard full size ice (which is normally full size ice cubes or ice half-moons in shape, for example) and then stores the standard full size ice in the storage chamber or region SC, SC' of the ice bucket 251, 251'. When the user/customer desires to dispense ice nuggets, the standard full size ice is augered in a direction towards the front cover C, C' of the ice bucket 251, 251' first to the crushing chamber or region CC, CC' where the standard full size ice is crushed into ice pieces of a controlled size. The crushed ice pieces are then augered through either the burr gear assembly 286 or augered along by the elongated front auger 310. The crushed ice pieces or ice slush is then forced into the extrusion head 294, 294' in the extrusion chamber or region EC, EC', located at the front end opening 252, 252' of the ice bucket 251, 251', where the crushed ice pieces are forced through the openings 295, 295' of the extrusion head 294, 294' to finally form the ice nuggets. Thus, the ice bucket assembly 250, 250' can produce nugget ice from existing ice produced by an ice maker in any shape where the formed ice nuggets are dispensed as they are made, as opposed to being stored, thereby avoiding any clumping that may occur. FIG. 10 illustrates a view of the ice nuggets—IN—produced by the ice bucket assembly for producing nugget ice according to an exemplary embodiment consistent with the present disclosure and disposed in a drinking glass—D.

Moreover, the ice bucket assembly 250, 250' for producing nugget ice can be equipped in a refrigerator appliance at the time of manufacture, or interchanged with and used in place of a conventional or existing ice bucket assembly in a refrigerator appliance as an after-market retrofit device.

The present invention has substantial opportunity for variation without departing from the spirit or scope of the present invention. For example, while the ice bucket assembly 250 for producing ice nuggets is shown in an insulated ice compartment region 200 located in a fresh food compartment of a refrigerator appliance, the ice bucket assembly 250 for producing ice nuggets can also be located in a freezer compartment of a refrigerator appliance. In that case, the housing 231 forming the ice compartment region 200 would not have to be insulated and the ice maker can be an indirect cooling ice maker. Also, while FIG. 1 shows a French door-bottom mount (FDBM) style refrigerator, the present invention can be utilized in FDBM configurations having one or more intermediate compartments (such as, but not limited to, pullout drawers) that can be operated as either fresh food compartments or freezer compartments and which are located between the main fresh food compartment and the main freezer compartment, a side-by-side refrigerator where the refrigerator compartment and the freezer compartment are disposed side-by-side in a vertical orientation, as well as in other well-known refrigerator configurations, such as but not limited to, top freezer configurations, bottom freezer configurations, and the like.

Those skilled in the art will recognize improvements and modifications to the exemplary embodiments of the present invention. All such improvements and modifications are considered within the scope of the concepts disclosed herein and the claims that follow.

What is claimed is:

1. An ice bucket assembly for use with an ice maker in a refrigerator, the ice bucket assembly comprising:

a storage chamber configured to store ice pieces made by the ice maker of an ice maker assembly disposed over a housing in an ice compartment region of the refrigerator;

a crushing chamber configured to crush the ice pieces made by the ice maker and stored in the storage chamber and thereby produce crushed ice;

an extrusion chamber having an extrusion head configured to produce nugget ice from the crushed ice from the crushing chamber;

wherein the storage chamber, the crushing chamber, and the extrusion chamber are arranged horizontally within the ice bucket assembly;

at least one auger disposed in the storage chamber and configured to move the ice pieces, whether uncrushed or crushed, through the storage chamber, the crushing chamber, and the extrusion chamber to be dispensed as the nugget ice; and a front cover disposed vertically and proximate to the extrusion chamber and configured to be received by and cover a housing collar disposed at a front portion of the housing in the ice compartment region, the front cover having an opening for discharging the nugget ice from the extrusion chamber.

2. The ice bucket assembly of claim 1, wherein the ice bucket assembly is configured to be inserted and withdrawn from the housing, of the ice compartment region of the refrigerator as a removable ice bucket assembly.

3. The ice bucket assembly of claim 1, wherein the opening of the front cover is disposed in a bottom portion of the front cover for discharging the nugget ice.

4. The ice bucket assembly of claim 1, wherein the extrusion head comprises a fixed extrusion plate having a plurality of extrusion openings, and a rotatable ice breaker which includes a curved surface to produce the nugget ice of a desired length.

5. The ice bucket assembly of claim 1, wherein the ice bucket assembly comprises an ice bucket formed by an ice bucket bottom cover, the ice bucket bottom cover having an enlarged rear portion with an open top that forms the storage chamber where the ice pieces produced by the ice maker fall into and collect for storage until being dispensed as the nugget ice.

6. The ice bucket assembly of claim 1, wherein the nugget ice produced by the extrusion head is smaller in size as compared to the ice pieces made by the ice maker and stored in the ice bucket assembly prior to production of the nugget ice.

7. The ice bucket assembly of claim 1, wherein the storage chamber, the crushing chamber, the extrusion chamber, and the at least one auger are arranged horizontally in order from a rear of the ice bucket assembly to the front cover, such that the extrusion head is disposed proximate to the opening in the front cover.

8. The ice bucket assembly of claim 2, wherein the ice bucket assembly is inserted and withdrawn from a location between a positioning wall disposed internal to the housing of the ice compartment region, and a side wall of the housing of the ice compartment region.

* * * * *